US008695719B2

(12) United States Patent
Retzloff et al.

(10) Patent No.: US 8,695,719 B2
(45) **Date of Patent: *Apr. 15, 2014**

(54) COVER PLATE FOR CONCEALED SPRINKLER

(75) Inventors: James G. Retzloff, Murchson, TX (US); Scott T. Franson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/517,646

(22) Filed: Jun. 14, 2012

(65) Prior Publication Data

US 2012/0247792 A1 Oct. 4, 2012

Related U.S. Application Data

(62) Division of application No. 10/967,712, filed on Oct. 18, 2004, now Pat. No. 8,220,556, which is a division of application No. 09/809,454, filed on Mar. 15, 2001, now Pat. No. 6,805,203.

(51) Int. Cl.
*A62C 37/08* (2006.01)

(52) U.S. Cl.
USPC ..... 169/37; 169/42; 239/288

(58) Field of Classification Search
USPC ..... 239/288, 288.3, 288.5, 499, 504, 506, 239/507, 512, 524; 169/37–42, 56, 57; 220/366.1
See application file for complete search history.

(56) References Cited

U.S. PATENT DOCUMENTS

| | | | | |
|---|---|---|---|---|
| 3,998,273 | A | 12/1976 | Juliano | |
| 4,066,129 | A | 1/1978 | Anderson | |
| 4,105,076 | A | 8/1978 | Simons et al. | |
| 4,706,759 | A | 11/1987 | Grasseschi | |
| 4,880,063 | A | 11/1989 | Leininger et al. | |
| 4,926,946 | A * | 5/1990 | Polan | 169/37 |
| D318,096 | S | 7/1991 | Polan | |
| 5,117,916 | A | 6/1992 | Ohta et al. | |
| 5,152,344 | A | 10/1992 | Fischer et al. | |
| 5,372,203 | A | 12/1994 | Galaszewski | |
| 6,805,203 | B2 * | 10/2004 | Retzloff et al. | 169/37 |

* cited by examiner

*Primary Examiner* — Christopher Kim
(74) *Attorney, Agent, or Firm* — Harness, Dickey & Pierce, P.L.C.

(57) ABSTRACT

A cover plate for a concealed sprinkler includes a member having at least one passageway section enabling heated air to pass between the cover plate and the sprinkler housing and towards the sprinkler head to permit the timely activation of the sprinkler head. In one embodiment, the passageway section is defined by one or more undulations formed within the cover plate, each of which define a ridge at the periphery, enabling air to pass therethrough. The cover plate includes a plurality of mounting tabs upon which a fusible material is applied to adhere the cover plate to the housing of the sprinkler head. The cover plate of the present invention increases the response time of the concealed sprinkler head while maintaining a low profile, discrete appearance.

17 Claims, 9 Drawing Sheets

COVER PLATE FOR CONCEALED SPRINKLER

CROSS-REFERENCE TO RELATED APPLICATIONS

This application is a divisional of U.S. patent application Ser. No. 10/967,712, filed on Oct. 18, 2004, which is a divisional of U.S. patent application Ser. No. 09/809,454, filed Mar. 15, 2001 (now U.S. Pat. No. 6,805,203). The entire disclosures of each of the above applications are incorporated herein by reference.

FIELD

The present disclosure relates generally to fire protection sprinkler systems, and more particularly, to a cover plate for a concealed fire sprinkler head.

BACKGROUND

This section provides background information related to the present disclosure which is not necessarily prior art.

Sprinkler heads have long been used in automatic fire extinguishing systems in order to controllably disperse a fluid in order to suppress or extinguish a fire in a designated area. Typically, the fluid utilized in automatic fire extinguishing systems is water, however, systems have also been advanced to disperse other fire extinguishing fluids. In one common design, sprinkler heads include a solid metal base with a central orifice having an inlet connected to a pressurized supply of water or other fire extinguishing fluid. A deflector, spaced from the sprinkler body, alters the trajectory of the water in an optimum pattern when discharged from the central orifice. In many conventional sprinkler heads, the deflector is fixedly spaced from the outlet by a pair of rigid arms and mounted on a boss joining the arms. A thermally sensitive trigger assembly is positioned between the deflector, boss and the central orifice outlet and sealingly engages a sealing assembly, which under non-activated conditions, prohibits water flow from the outlet. When the temperature reaches a preselected value indicative of a fire, the trigger assembly releases the sealing member and permits the expulsion of water from the outlet.

In another common design, often referred to in the industry as a concealed, recessed or flush sprinkler head, the structure in which the sprinkler body is positioned has a recess or cavity, sized to enable the insertion of the sprinkler body. The deflector is movably supported proximate to the outlet, with in a cavity formed in the sprinkler body. A housing is attached to, and extends beyond the bottom region of the sprinkler body and includes an annular flange positioned about the exterior perimeter of the cavity in which the sprinkler body is located. A sealing assembly, located within the interior of the sprinkler body, seals the outlet of the sprinkler body and is maintained in a closed position by a pair of pins or actuators depending from the bottom of the sprinkler body. The pins are held in an inwardly biased or closed position by a thermally sensitive trigger assembly, positioned between the sprinkler body and the bottom of the housing, which is thermally responsive in the temperature range indicative of a fire. Under normal temperatures, the presence of the thermally sensitive trigger assembly prohibits fluid flow through the central orifice. When the temperature within the designated area rises to a preselected value due to the presence of fire, the thermally sensitive trigger assembly fuses, or ruptures, causing the pins to move in an outward direction, and in consequence, results in the movement of the deflector away from the outlet of the sprinkler body, with its movement halted a preselected distance within the interior of the designated area. Activation of the thermally sensitive trigger assembly also releases the sealing assembly, enabling pressurized fluid to travel through the sprinkler body and be expelled therefrom. Once expelled from the outlet, the fluid impacts the deflector, and its trajectory is altered in an optimum pattern.

Concealed sprinkler heads are commonly equipped with a concealing cover plate which is coupled to the housing. When the deflector is expelled from the housing, it dislodges the cover plate, causing its motion away from the sprinkler head. Under normal conditions, the cover plate conceals the interior of the sprinkler body from view, and in most instances, completely encloses the bottom of the housing.

As the thermally sensitive trigger assembly in a concealed sprinkler is normally positioned above the annular flange, or, at least co-planar therewith, the presence of a cover plate reduces the air flow received by the thermally sensitive trigger assembly. As the air flow rate impacting the thermally sensitive trigger assembly is reduced, the heat transfer rate to the thermally sensitive trigger assembly also decreases. In consequence of the reduced air flow rate, the thermally sensitive trigger assembly is elevated to the preselected activation temperature at a slower rate, and reduces the response time of the sprinkler head.

In response to slow activation times, cover plates have been provided with a plurality of central openings or slots, often formed in surfaces projecting from the center of the cover plate, to permit the heat to pass therethrough and impact the thermally sensitive trigger assembly. These airway openings, however, draw attention to the cover plate and diminish the cover plate's ability to perform its function of providing an aesthetic cover that does not visually detract from the ceiling or sidewall in which the sprinkler head is positioned.

Consequently, there is a need for a cover plate which conceals the sprinkler head interior, provides an aesthetic, low profile cover, permits heat to be directed to the thermally responsive trigger assembly, and is configured to be immediately and effectively dislodged from the housing in response to a fire.

SUMMARY

This section provides a general summary of the disclosure, and is not a comprehensive disclosure of its full scope or all of its features.

According to one aspect of the invention, a concealed sprinkler head includes a thermally sensitive trigger assembly, a housing having a mounting surface and a central opening in fluid communication with the thermally sensitive trigger assembly, and a cover plate including a body member mounted to the mounting surface and having a periphery. The periphery has at least one passageway section and an adjacent periphery section adjacent the passageway section, with the passageway section disposed further from the mounting surface then the adjacent periphery section. A cover plate configured with at least one passageway section formed along the periphery provides an effective structure for enabling the passage of air towards the sprinkler head and thus decreases sprinkler response time while maintaining an aesthetically appealing, low profile appearance.

According to another aspect of the invention, a concealed sprinkler head includes a thermally sensitive trigger assembly, a housing with an annular flange and a central opening in which the thermally sensitive trigger assembly is positioned, and a cover plate having a body member formed with a periphery and a center. At least one mounting tab extends from the periphery, towards the center, and is attached to the annular flange by a fusible material. At least a section of the periphery is configured to permit the passage of air into the central opening and towards the thermally sensitive trigger assembly. Configuring the peripheral region of a cover plate to permit heated air to flow towards the sprinkler head results in greater sensitivity to the sprinkler head, while the at least one mounting tab provides a facile, reliable attachment structure.

According to yet another aspect of the invention, the cover plate includes a body member having at least one undulation formed therein. The undulation forms a passageway section at the periphery of the body member and provides an aesthetically appealing design, while enabling heated air to reach the thermally sensitive trigger assembly, and in consequence, increase the response time thereof.

According to still yet another aspect of the invention, a concealed sprinkler head comprises a sprinkler body having a central orifice with an inlet, and outlet, a deflector movably mounted to the sprinkler body, and a thermally sensitive trigger assembly configured to urge a sealing assembly into sealing engagement with the outlet. A housing is attached to the sprinkler body and has a bottom extending beyond the outlet, while the thermally sensitive trigger assembly is positioned between the outlet and the bottom of the housing. A cover plate is removably mounted to the bottom of the housing, with at least a section of its periphery formed with at least one passageway section configured to enable air to travel between the passageway section and the housing bottom and towards the thermally sensitive trigger assembly.

According to a further aspect of the invention, a concealed sprinkler head comprises a sprinkler body with a central orifice, a deflector movably mounted to the sprinkler body, a sealing assembly for sealing the outlet, and a thermally sensitive trigger assembly configured to releasably urge the sealing assembly into engagement with the outlet of the central orifice. A housing is attached to the sprinkler body and has a central opening and a bottom extending beyond the outlet. The bottom is formed with an annular flange having at least one contact section depending below the annular flange. A cover plate includes at least one mounting section having a contact member. The contact member enables the cover plate to be attached to the annular flange such that in the assembled position, the at least one contact section is in substantial registry with the contact member. The cover plate has a periphery formed with at least one passageway section configured to enable air to travel between the passageway section and the bottom of the housing and towards the thermally sensitive trigger assembly. The registry of the contact member with the contact section depending from of the annular flange provides secure attachment of the annular flange to the cover plate, while the cover plate enables heated air to travel therethrough and contact the thermally sensitive trigger assembly, thereby decreasing response time.

These and other objects, advantages, purposes and features of the invention will become apparent upon review of the following specification in conjunction with the drawings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
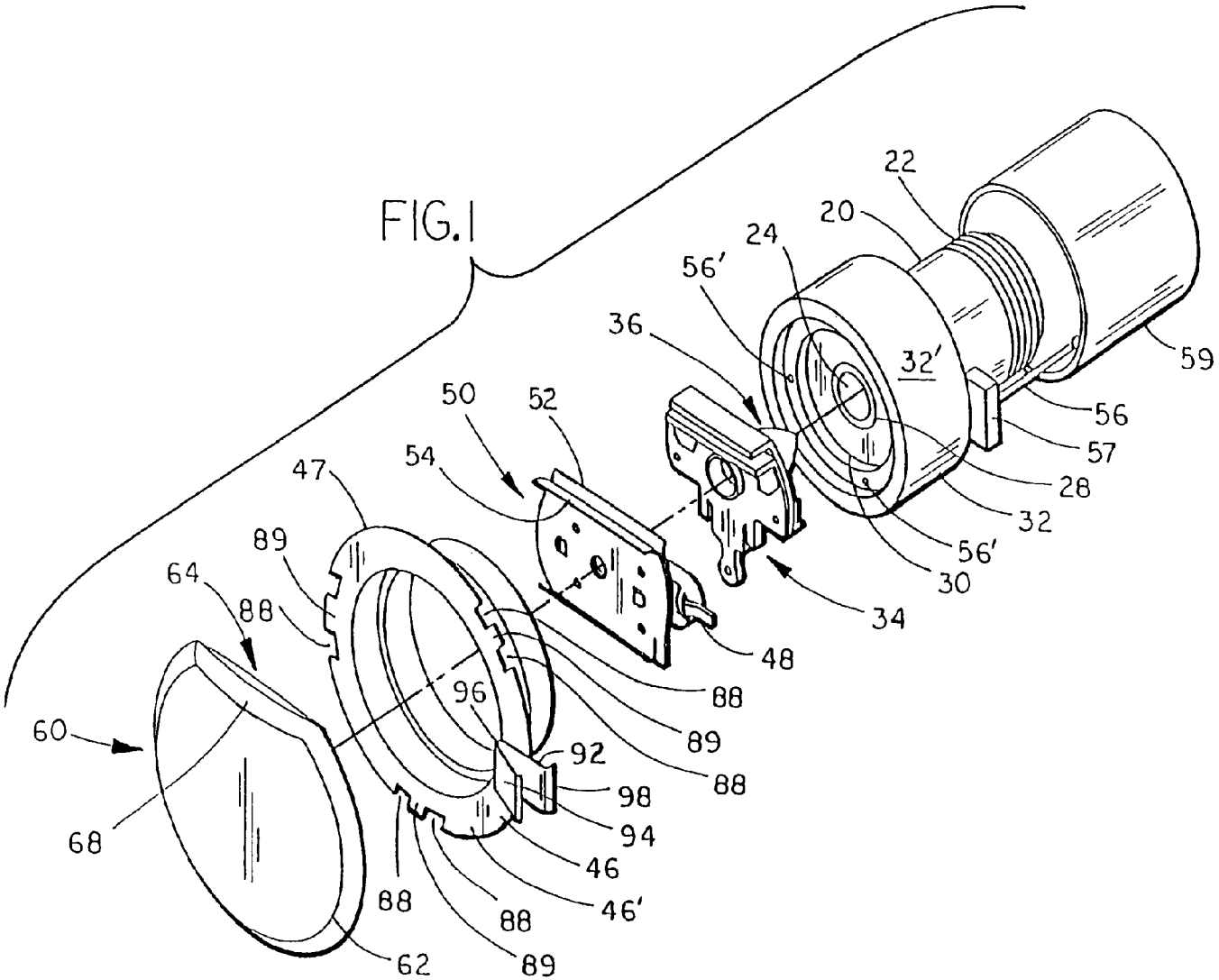
FIG. 1 is an exploded perspective view of the cover plate and concealed sprinkler head according to a preferred embodiment of the invention.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present invention is directed to a unique cover plate for use in conjunction with a concealed or recessed sprinkler head. The cover plate of the present invention permits heated air to travel therethrough and impact the thermally sensitive trigger assembly to thereby increase the response time of the recessed sprinkler head, while maintaining a low profile, sleek aesthetic appearance which does not detract from the side wall or ceiling structure in which it is placed. The present invention will now be described with reference to the accompanying drawings wherein the like reference numerals correspond to like elements in the several drawings.

Figure 3:
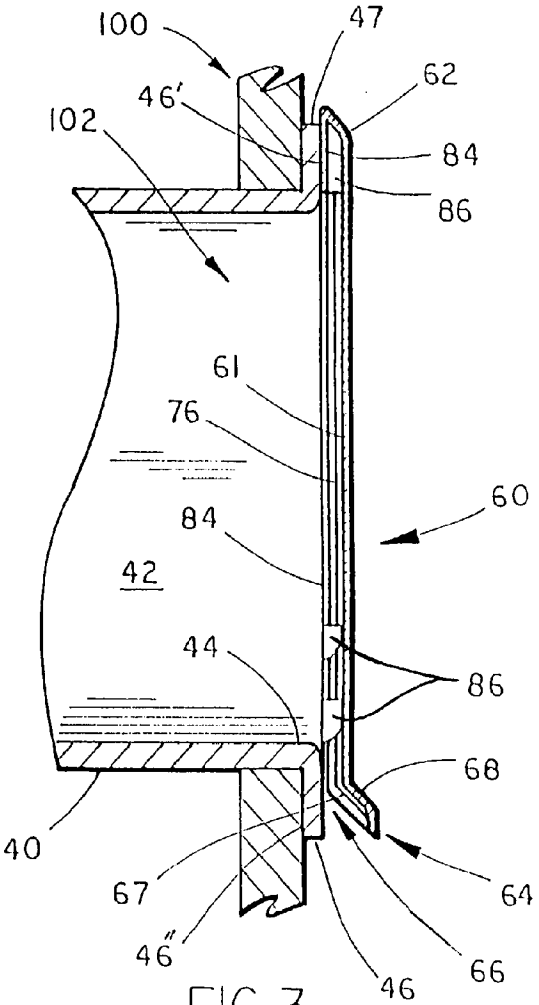
FIG. 3 is a cross-sectional view taken along line III-III of FIG. 2.

Referring now to the drawings, a concealed sprinkler head 10 normally contains a sprinkler body 20 having an upper section 22. Upper section 22 is externally threaded, allowing removable attachment to a fire extinguishing fluid supply line, normally in the form of a pipe, and positioned within a sidewall or ceiling. This pipe is in fluid communication with a source of pressurized fire extinguishing fluid. A central orifice 24 is formed in sprinkler body 20, allowing the movement of fluids from an inlet through an outlet 28. A cavity 30, defined by annular member 32 of sprinkler body 20, extends beyond outlet 28. Sprinkler body 10 movably supports a fluid deflector 34, and a sealing assembly 36 placed in sealing engagement with outlet 28 during normal, non-activated conditions. A housing 40 is fixedly attached to the exterior surface 32' of annular member 32. Housing 40 depends beyond annular member 32 of sprinkler body 20 and includes a central opening 42 and a bottom 44 formed with an annular flange 46. Annular flange 46 is substantially orthogonal to housing 40 and is dimensioned to conceal the recess or cutout section 102 formed within sidewall 100 into which sprinkler body 20 is inserted (FIG. 3).

A pair of arms or levers 48 depend from outlet 28 of sprinkler body 20. Pins 48 are normally biased in an outward direction but are held together in an inwardly biased position by a thermally sensitive trigger assembly 50. Thermally sensitive trigger assembly 50 receives the lower end of levers 48 and holds the same in a state of tension so that deflector 34 remains in its preselected position proximate to sprinkler body 20, and sealing assembly 36 remains in sealing engagement with outlet 28 during non-activated conditions. A cylindrical member 59 is positioned over upper region 22 of sprinkler body 20 and rests on edge 32" of annular member 32. Cylindrical member 59 prevents the intrusion of debris into upper region 22.

Thermally sensitive trigger assembly 50 may be any trigger assembly commonly known in the art. For example, thermally sensitive trigger assembly 50 includes one or more plates 52 and, 54, joined by heat fusible material, such as a suitable solder. Plates 52, 54 are each formed with an aperture which receives and holds the ends of levers 48 in the closed position. In the closed or non-activated position, thermally sensitive trigger assembly 50 will be positioned either within cavity 30 of annular member 32 or within a central opening 42 of housing 40, a preselected distance from bottom 44. When subjected to a preselected temperature, the fusible material will fuse, causing the release of plates 52, 54. Upon release, levers 48 move to their outwardly biased position which releases sealing assembly 36, and results in the expulsion of deflector 34 from its position proximate to outlet 28. Pins or guide rods 56, slidably positioned within apertures 56' formed in sprinkler body 20 are attached to deflector 34 and halt the progression of deflector 34 such that it is supported a preselected distance within the protected area. A pair of wrench ears 57 extend from sprinkler body 20 and permit an operator to secure sprinkler head 10 to a piping system (not shown) with a wrench or other suitable tool. Thereafter, pressurized water or other fire extinguishing fluid travels through sprinkler body 20 and into the protected area to suppress or extinguish a fire. The previous description of sprinkler head 10 is illustrative of a concealed sprinkler head. A suitable sprinkler head for use with this invention is disclosed in commonly assigned U.S. application Ser. No. 09/438,141, filed Nov. 10, 1999, and entitled Double-Blade Deflector for Side Wall Sprinkler, now U.S. Pat. No. 6,367,559, the disclosure of which is hereby incorporated herein by reference. However, it will be understood that other configurations for sprinkler head 10 may be used without departing from the spirit and scope of the present invention. It will be further understood that although sprinkler head 10 has been described as a concealed side wall sprinkler head, the present invention is equally applicable to concealed sprinkler heads mounted within a ceiling or other horizontal body.

A cover plate 60 is mounted to external surface 46' of annular flange 46 of housing 40. Cover plate 60 includes a periphery 62 having formed therein at least one passageway section 64, configured to enable heated air to pass through the gap or interstice 66 formed between air passageway 64 and annular flange 46 and travel through central opening 42 of housing 40 and impact thermally sensitive trigger assembly 50. Passageway section 64 is disposed further away from annular flange 46 than the adjacent periphery section of cover plate 60. In a preferred form, passageway section 64 is at least one lip 68 formed along periphery 62 of cover plate 60 and projecting in a direction away from annular flange 46. Preferably, lip 68 forms a substantially linear crease 70 in cover plate 60, and includes an arcuate edge 72. Cover plate 60 has a central section 74 which is preferably substantially planar. The planar aspect of central section 74 of cover plate 60 maintains the low profile appearance of cover plate 60. Also, preferably, periphery 62 includes a rim 76 angled towards annular flange 46 of housing 40, while lip 68 is formed with a rim 67 projecting towards sidewall 110. Cover plate 60 may be formed of any conductive material commonly utilized in the art, such as, for example brass, and is preferably substantially circular in shape. Cover plate 60 is dimensioned to substantially conceal central opening 42 of housing 40, and thus prohibits the interior of sprinkler head 20 from being seen when in the assembled position. Preferably, lip 68 exhibits a preselected angle .alpha. of between approximately 15.degree. and 75.degree., more preferably between approximately 30.degree. and 65.degree., and most preferably, approximately 45.degree.

Figure 16:
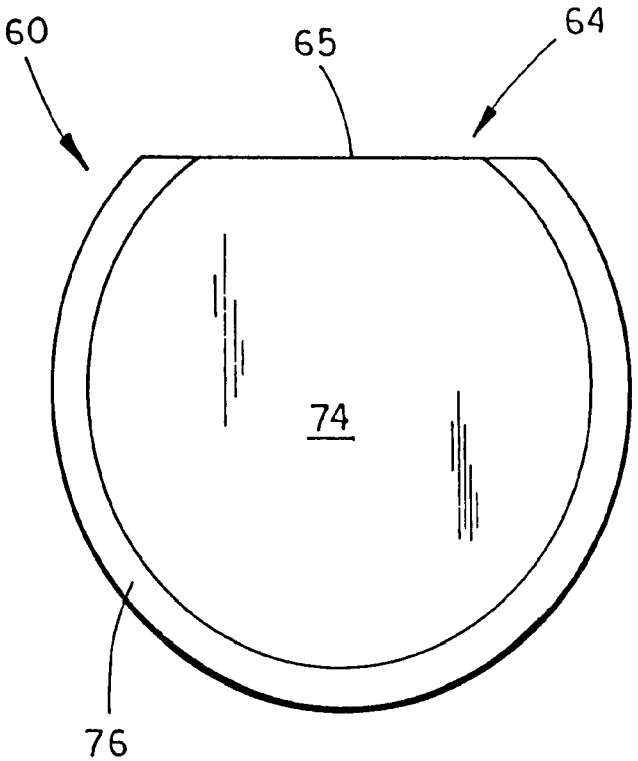
FIG. 16 is a plan view of a cover plate according to yet another alternative preferred embodiment.
Figure 17:
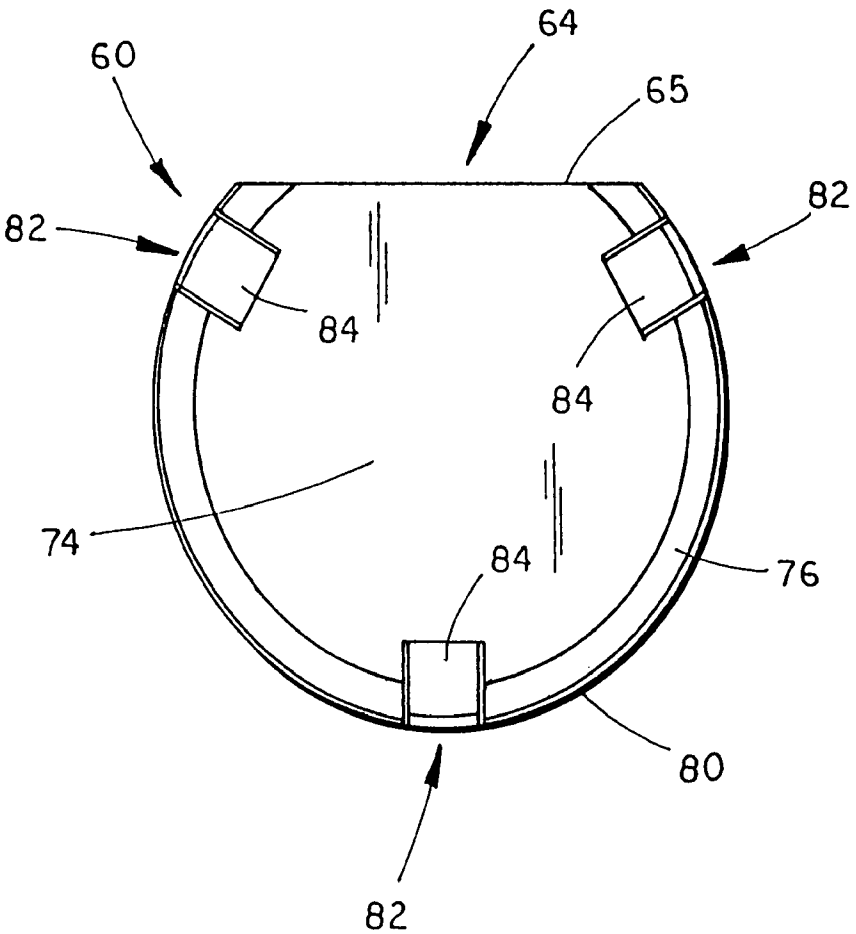
FIG. 17 is a bottom view of the cover plate of FIG. 16.

Alternatively, as depicted in FIGS. 16 and 17, passageway section 64, is defined by a cutout section 65 formed in periphery 62. Preferably, cutout section 65 is generally planar while the remainder of periphery 62 is substantially arcuate in shape. Unlike lip 68, cutout section 65 does not include an arcuate edge, and thus defines passageway section 64 to enable heated air to pass between passageway section 64 and annular flange 46, and travel through central opening 42 of housing 40 and impact thermally sensitive trigger assembly 50.

Formed along edge 80 of rim 76 are one or more mounting tabs 82. Mounting tabs 82 are placed in spaced relation, and extend inwardly towards the center of cover plate 60. Mounting tabs 82 have a general C-shape with a contact member 84 generally parallel to inner surface 61 of cover plate 60, and a pair of end members 86 depending substantially orthogonally from contact member 84 and towards inner surface 61. Annular flange 46 of housing 40 defines a mounting surface for cover plate 60 and is formed with one or more sets of notches 88 placed in spaced relation. Each pair of notches 88 define a contact surface 89 therebetween. The number of contact surfaces 89 formed in annular flange 46 corresponds to the number of mounting tabs 82 formed in cover plate 60. To couple or attach cover plate 60 to annular flange 46, a suitable fusible material, such as a solder, having a known fusing temperature is placed on contact surface 89 of annular flange 46, and cover plate 60 is aligned such that contact members 84 will be in alignment or registry with contact surfaces 89. The fusible material employed is application specific as fusible materials have different fusing temperatures, and thus will be within the purview of one with ordinary skill in the art.

Figure 14:
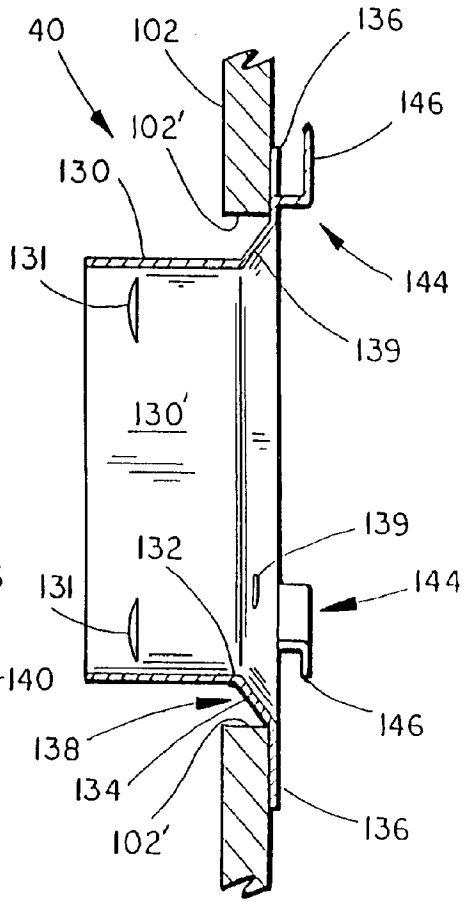
FIG. 14 is a sectional view taken along line XIV-XIV of FIG. 13.
Figure 13:
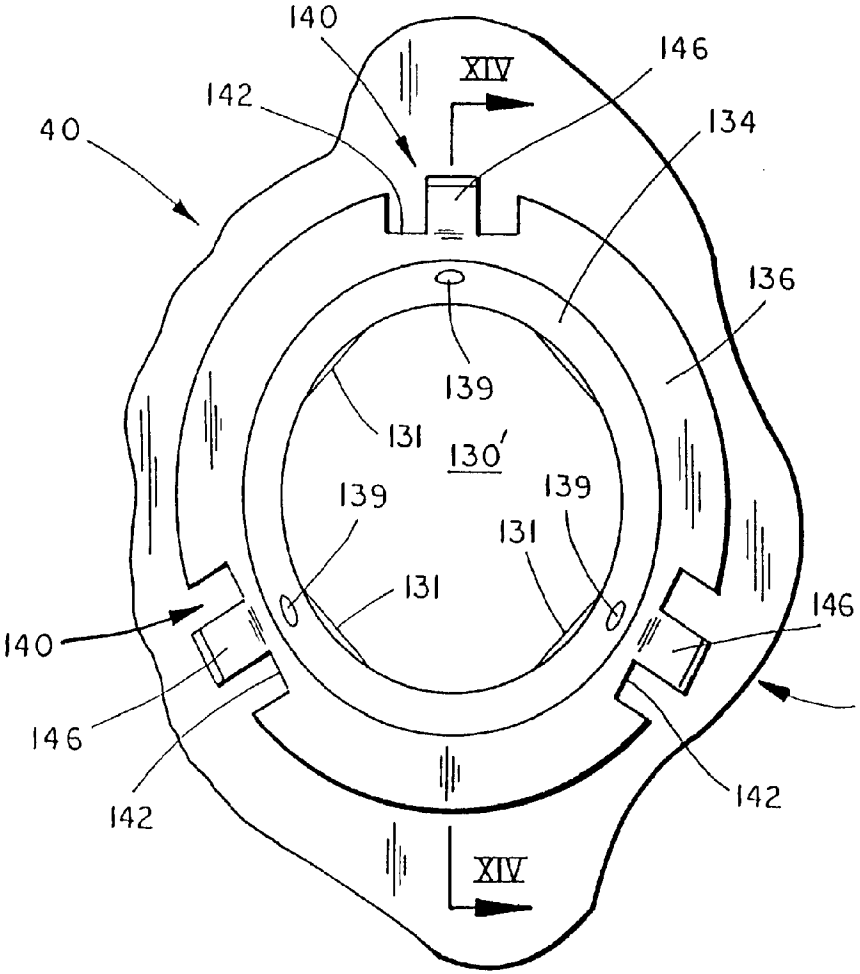
FIG. 13 is a bottom view of a housing according to an alternative preferred embodiment.

In an alternative preferred embodiment, as shown in FIGS. 13 and 14, housing 40' includes a generally cylindrical section 130 and an outwardly flared or angled ledge 134 formed at bottom 132. Cylindrical section 130 may have one or more tabs 131 projecting within central opening 130'. The purpose of tabs 131 is to provide frictional engagement between cylindrical section 130 and exterior surface 32' of annular member 32 and prevent inadvertent removal of housing 40' from annular member 32. A generally horizontal annular flange 136 extends from ledge 134. When housing 40' is in position, wall 102' of cutout section 102 terminates prior to ledge 134, and thereby forms an annulus 138. Annular flange 136 has a plurality of cut-out sections 140, each having an edge 142. Depending from each outer edge 142 of cut-out section 140 is a generally L-shaped member 144. L-shaped member 144 includes a planar contact section 146 which defines a contact surface to which contact member 84 of cover plate 60 is joined by the use of an appropriate fusible material. Contact section 146 of L-shaped member 144 resides in a horizontal plane spaced from the plane defined by annular flange 136. Formed in ledge 134 are a plurality of throughholes 139. Each throughhole 139 is located proximate to a cutout section 140. The purpose of throughholes 139 is to provide an air exhaust passageway, enabling heating air to contact horizontal section 146 and be exhausted into annulus 138. Providing an air flow passageway through which heated air contacts horizontal sections 146 of L-shaped members 144, contact members 84, and the fusible material therebetween, and is subsequently evacuated from housing 40' through throughholes 139 increasing the air flow rate. This increase in the air flow increases the rate at which the fusible material achieves the fusing temperature, and assures the timely separation of cover plate 60 from housing 40'.

Figure 18:
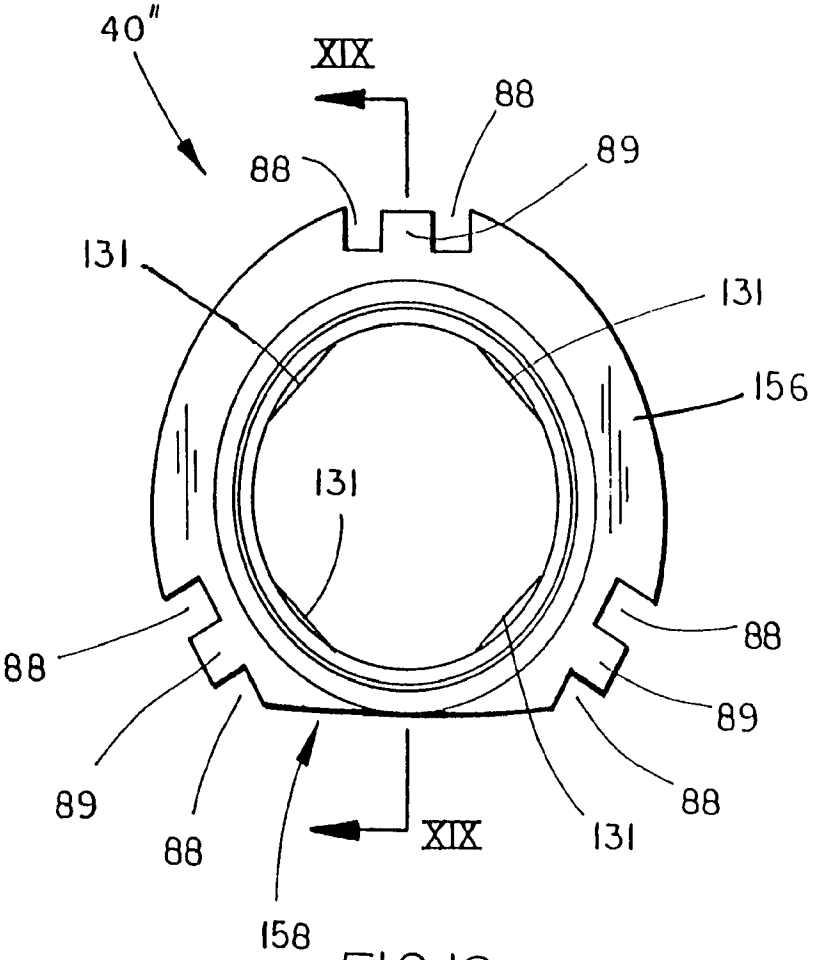
FIG. 18 is a bottom view of a housing according to another alternative preferred embodiment.
Figure 19:
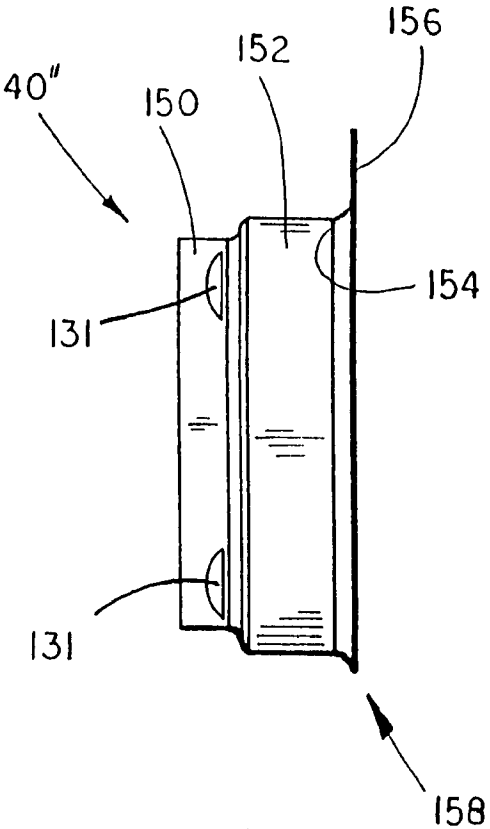
FIG. 19 is a sectional view taken along line XIX-XIX of FIG. 18.

When employing cover plate 60 having a passageway section 64 defined by cutout section 65, a housing 40", as shown in FIGS. 18 and 19, is preferably employed. Housing 40" includes an upper section 150 and a larger diameter lower section 152. Upper section 150 preferably includes one or more tabs 131. Extending from bottom region 154 of lower section 152 is an annular flange 156. Annular flange 156 includes one or more sets of notches 88 placed in space relation with each pair of notches 88 defining a contact surface 89 therebetween. Unlike housing 40, housing 40" includes a cutout section 158 formed in annular flange 156. Preferably, cutout section 158 is slightly arcuate. When cover plate 60, having cutout section 65 is used in conjunction with housing 40", cover plate 60 is attached to housing 40" in the manner discussed above, so that cutout section 158 of annular flange 156 is in substantial registry with cutout section 65 of cover plate 60. The substantial registry between cutout sections 65 and 158 provide an aesthetically attractive appearance while enabling air to pass through the passageway section 64 defined by cutout section 65 and travel towards thermally sensitive trigger assembly 50.

In order to assure the effective thrusting or dislodgment of cover plate 60 from housing 40, once the fusible material achieves the requisite fusing temperature, a spring 90 is positioned between cover plate 60 and exterior surface 46' of annular flange 46. In a preferred form, spring 90 includes a substantially linear first section 92 and a substantially linear second section 94 joined together at a preselected angle .beta. by an arcuate bridge section 96. First section 92 of spring 90 is slightly greater in length than second section 94, and both have at their free ends an angled tab 98, 98', respectively, extending in substantially the same direction. In the assembled position, tab 98 is in abutting contact with, or in proximity to, edge 47' of annular flange 46, while tab 98' is substantially contoured to the inner surface of rim 76. The angle B formed by spring 90, in the non-compressed state, is between approximately 10.degree. and 30.degree., more preferably between approximately 15.degree. and 25.degree., and most preferably approximately 20.degree.

Spring 90 is positioned between annular flange 46 and cover plate 60 such that surface 92' of first section 92 is in abutting contact with exterior surface 46' of annular flange 46 with arcuate tab 98 contoured about edge 47 of annular flange 46, while surface 94' of second section 94 is positioned on edge 76' of rim 76, with tab 98' abutting first section 92 of rim 76. When cover plate 60 is attached to annular flange 46, first section 92 will be urged into proximity with second section 94 of spring member 90. That is, the angle .beta. defined by spring member 90 in the assembled position will be less than that in its non-compressed, unassembled position, and in consequence, will place spring member 90 in compression. When the fusible material positioned between annular flange 46 and cover plate 60 fuses, the compressive force of spring 90 will vigorously thrust cover plate 60 away from annular flange 46 and thereby assure the timely separation of cover plate 60 upon activation of sprinkler head 10.

Figure 8:
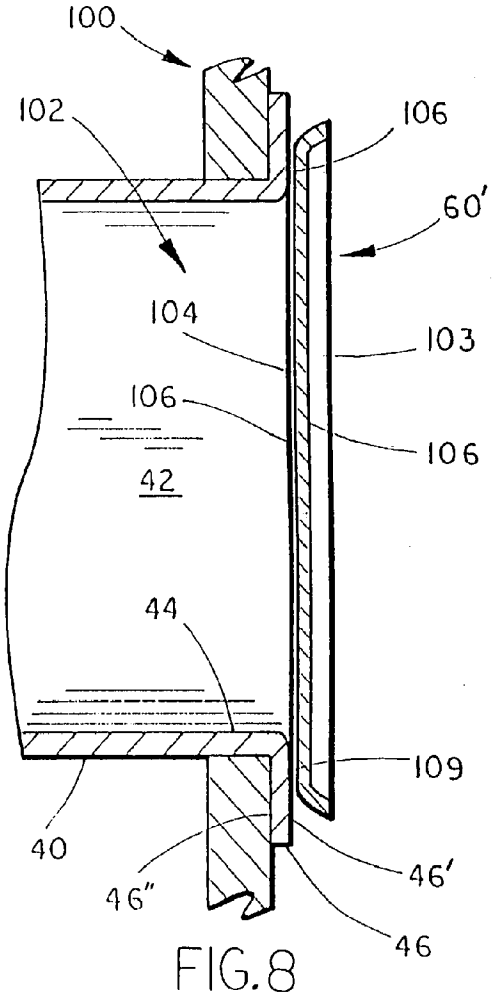
FIG. 8 is a sectional side view of a cover plate attached to a concealed sprinkler head located within a cavity according to an alternative preferred embodiment.
Figure 5:
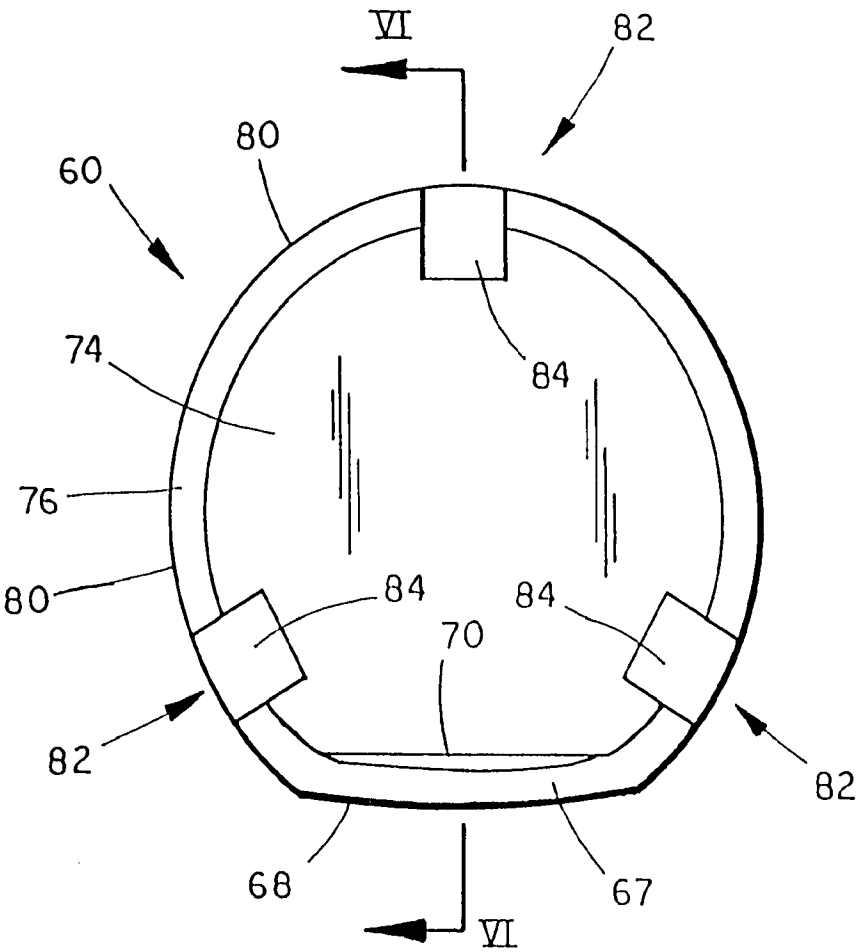
FIG. 5 is a bottom view of the cover plate of FIGS. 1-4.
Figure 4:
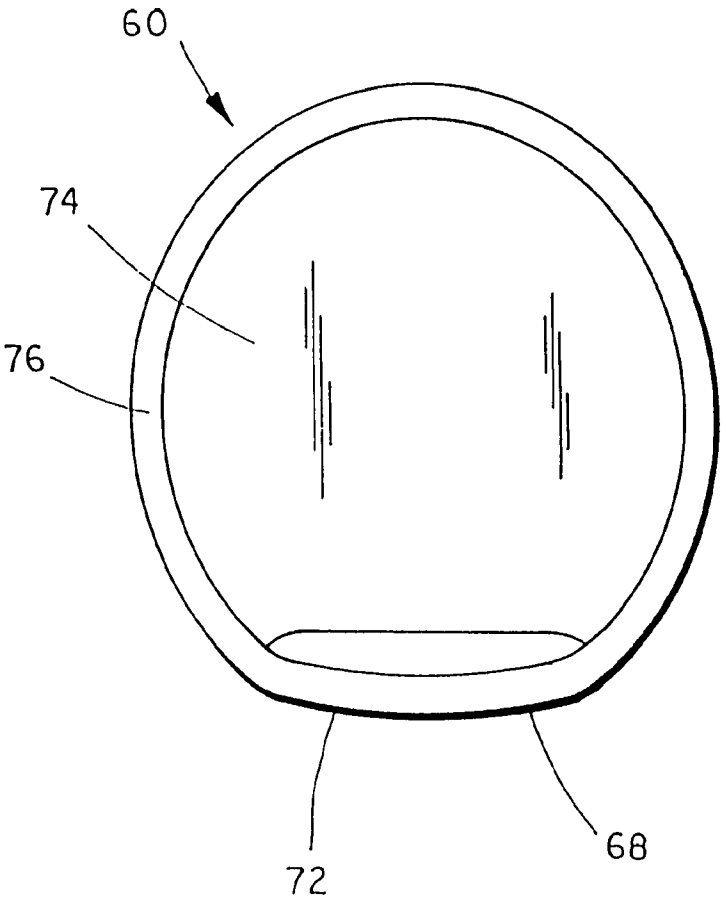
FIG. 4 is a plan view of the cover plate of FIGS. 1-3.
Figure 15:
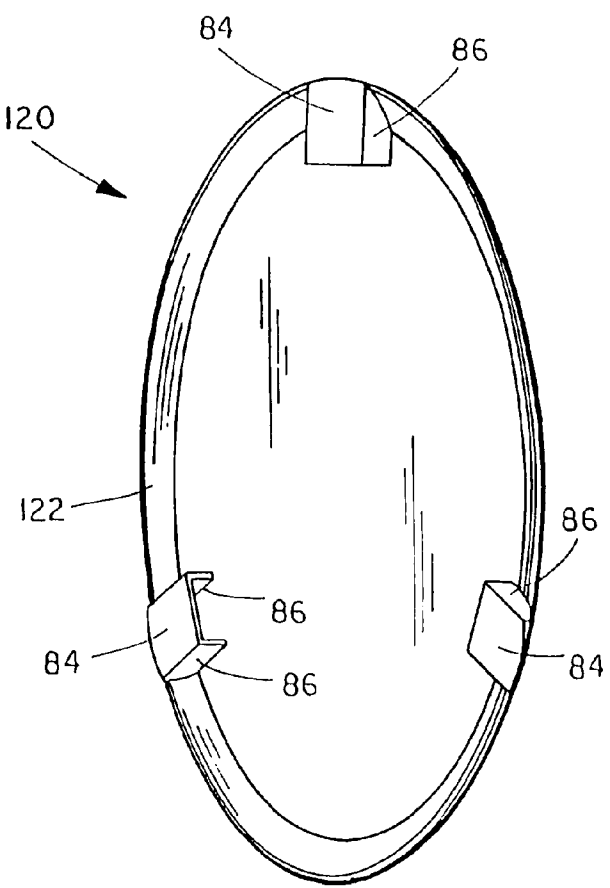
FIG. 15 is a perspective view of a cover plate according to another alternative preferred embodiment.
Figure 6:
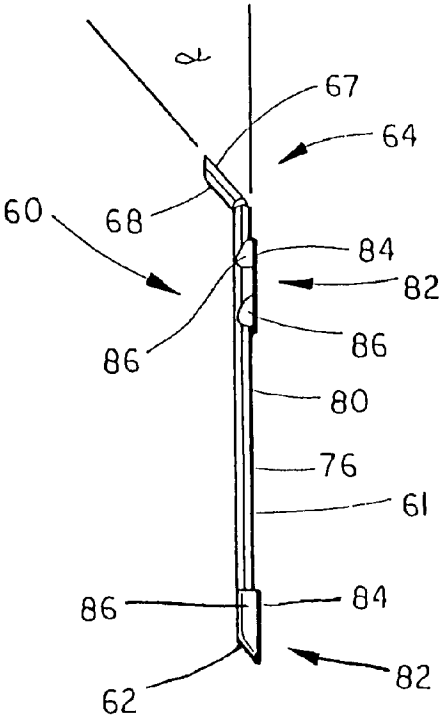
FIG. 6 is a sectional view taken along line VI-VI of FIG. 5.
Figure 7:
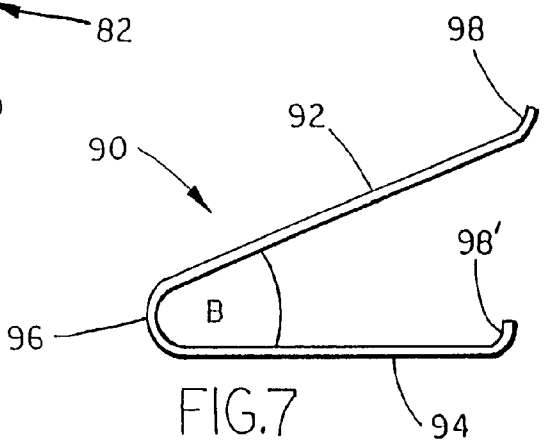
FIG. 7 is a side view of a spring according to the invention.

Turning now to FIG. 8, in an alternative preferred embodiment, a cover plate 60' includes a peripheral rim 103 projecting away from annular flange 46. In this embodiment, rim 76 formed in cover plate 60 is absent and cover plate 60' is of a generally uniform cross section having an interior surface 104 and an exterior surface 106. Center section 108 has a slightly larger diameter than central opening 42 of housing 40 so as to enable the attachment of cover plate 60' to annular flange 46 by application of a fusible material 106 at discrete, non-continuous points on interior surface 104. An interstice or open area 109 is formed between interior surface 104 and annular flange 46 by the application of fusible material 106. This interstitial area 109 provides a pathway for air to enter central opening 42 and travel towards thermally sensitive trigger assembly 50.

Figure 10:
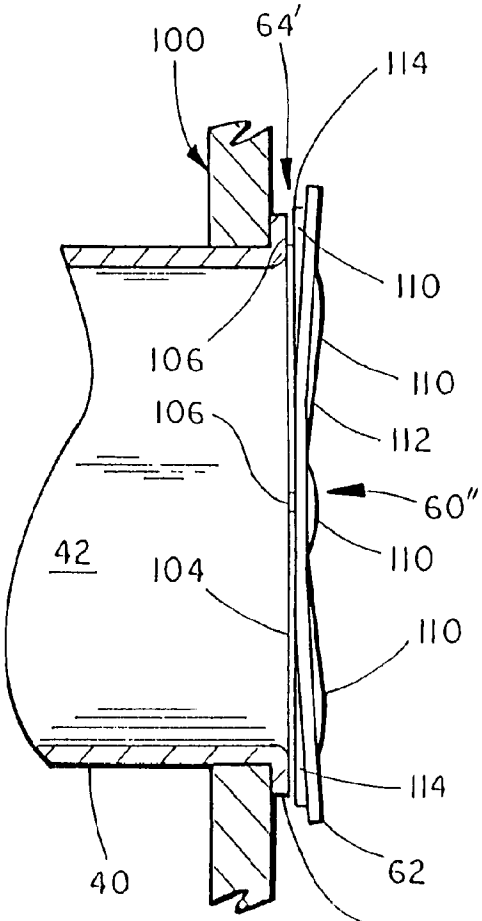
FIG. 10 is a sectional view taken along line X-X of FIG. 9.
Figure 9:
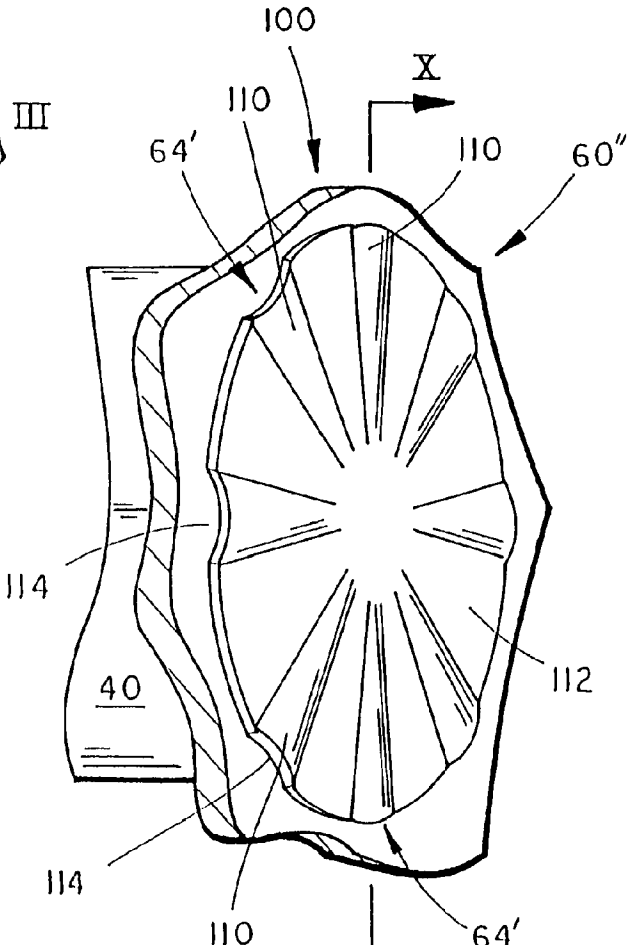
FIG. 9 is a perspective view of a cover plate shown in the assembled position, according to another alternative preferred embodiment.
Figure 2:
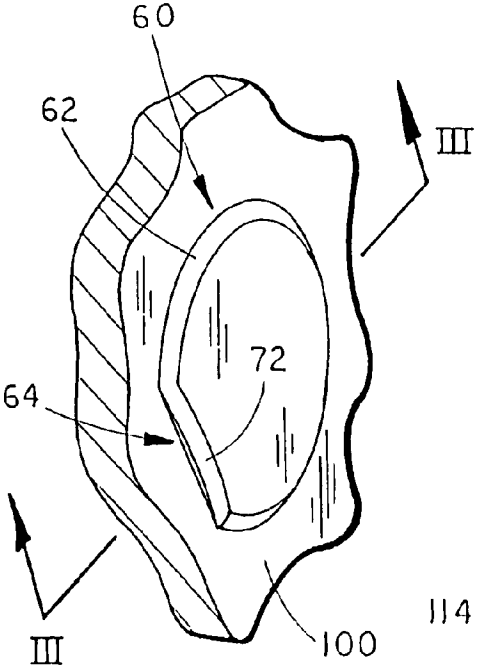
FIG. 2 is a perspective view of the cover plate of FIG. 1, shown in the assembled position.
Figure 12:
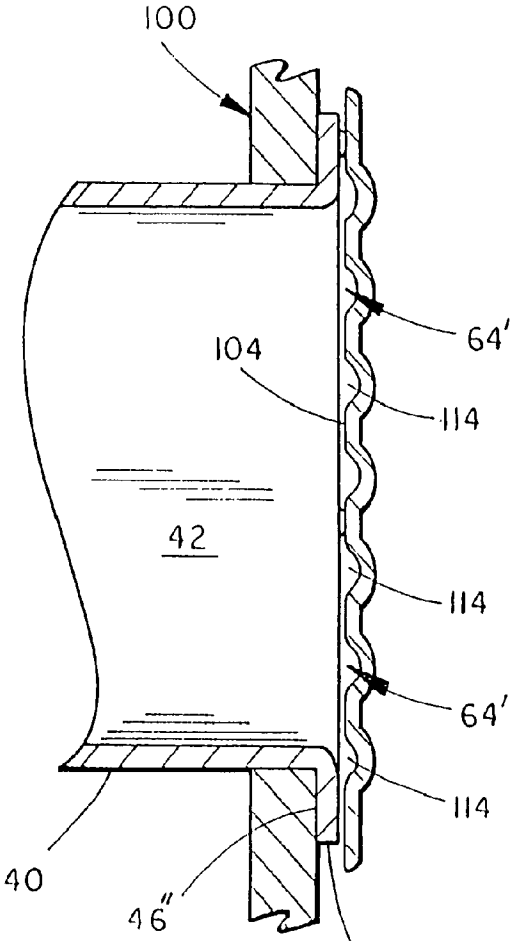
FIG. 12 is a sectional view taken along line XII-XII of FIG. 11.
Figure 11:
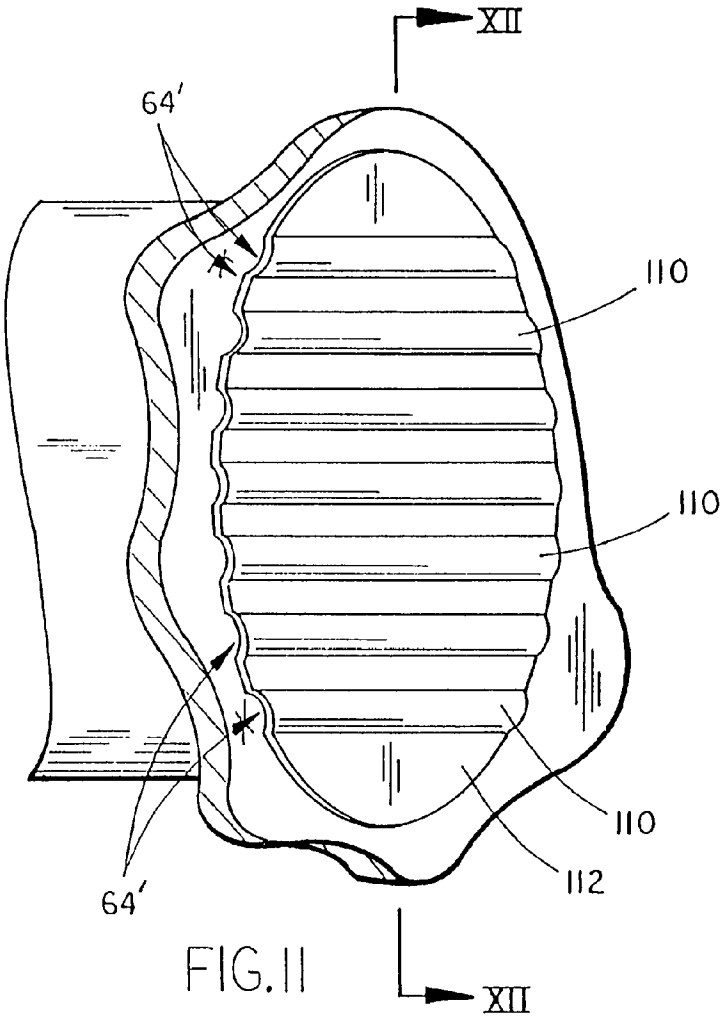
FIG. 11 is the same view as FIG. 9 of a cover plate according to another alternative preferred embodiment.

With reference to FIGS. 9 through 12, in another alternative preferred embodiment, a cover plate 60" is formed having a plurality of undulations or arcuate sections 110 formed therein projecting from the plane defined by exterior surface 112. Undulations 110 define ridges 114 on the interior surface 104 and periphery 62 of cover plate 60". Each ridge 114 provides a passageway section 64' enabling heated air to pass therethrough and towards thermally sensitive trigger assembly 50. In a preferred form, as shown in FIGS. 9 and 10, there are a plurality of undulations 110 extending in a radial pattern from the center of cover plate 60". In a preferred alternative, as shown in FIGS. 11 and 12, undulations 114 are formed in a longitudinal pattern. As with cover plate 60', cover plate 60" is attached annular flange 46 by the application of a fusible material 106 on interior surface 104 at discrete, non-continuous points between undulations 110.

In assembly, sprinkler head 10 is first assembled in accordance with normal industry procedure and inserted with the cavity 102. Thereafter, a fusible material is applied to mounting tabs 82 of cover plate 60, or interior surface 104 of cover plate 60', 60", and attached to annular flange 46, 46*a*. Subsequently, spring 90 is positioned between exterior surface 46' of annular flange 46, 46*a* and rim 76 of cover plate 60 or interior surface 104 of cover plate 60' or 60". Once spring 90 is in position, housing 40 and cover plate 60, 60', or 60" is attached to sprinkler body 20.

When using housing 40' having annular flange 136, a cover plate 120 may be attached thereto (FIG. 14). Cover plate 120 has a rim 122 spanning the entire periphery and is otherwise structurally similar to cover plate 60. Thus, in cover plate 120, passageway section 64 is absent. The L-shaped members 144 depending from annular flange 136, when attached to cover plate 120, space cover plate 120 a pre-selected distance from exterior surface 46', and thereby creates a circular passageway or interstice through which heated air may travel towards thermally sensitive trigger assembly 50 and towards the fusible material positioned between contact sections 146 of L-shaped members 144 and contact members 84 of cover plate 120.

The above detailed description is of the preferred embodiments only. Changes and modifications in the specifically described embodiments can be carried out without departing from the principles of the invention. Therefore, the invention is intended to be limited only by the scope of the appended claims as interpreted according to the principles of patent law including the doctrine of equivalents.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A concealed sprinkler head comprising:

a sprinkler head body having a central axis and a central orifice disposed about said central axis, said central orifice defining an inlet and an outlet, and said body configured for attachment to a fire extinguishing fluid supply line;

a deflector movably mounted to said sprinkler body;

a sealing assembly for sealing said outlet;

a thermally sensitive trigger assembly configured to releasably urge said sealing assembly into sealing engagement with said outlet;

a housing attached to said sprinkler body and having a flange extending beyond said outlet; and a cover plate removably mounted to said flange of said housing, said cover plate having an inner surface for facing said flange, an outer surface having a planar portion and an arcuate portion extending from an outermost radial periphery of the cover plate and projecting outwardly from said planar portion in a direction generally along said central axis away from said housing and away from said sprinkler head, said arcuate portion forming a passageway extending inwardly from the outermost radial periphery of the cover plate to enable air to travel between said outermost radial periphery and said flange of said housing and toward said thermally sensitive trigger assembly.

2. The concealed sprinkler head according to claim 1, wherein said at least one arcuate portion comprises a plurality of arcuate portions.

3. The concealed sprinkler head according to claim 2, wherein said arcuate portions are generally parallel.

4. The concealed sprinkler head according to claim 2, wherein said arcuate portions have generally parallel sides.

5. The concealed sprinkler head according to claim 1, wherein said arcuate portions are arranged in a radial pattern wherein said passageways extend from said outermost radial periphery inwardly along a radii to said central axis.

6. The concealed sprinkler head according to claim 1, further comprising a spring positioned between said inner surface of said cover and said flange of said housing.

7. The concealed sprinkler head according to claim 6, wherein said spring includes a first substantial linear section and a second substantial linear section joined by an arcuate section.

8. A concealed sprinkler head comprising:

a sprinkler body having a central axis and a central orifice disposed about said central axis, said central orifice defining an inlet and an outlet, said sprinkler body configured for attachment to a fire extinguishing supply line;

a deflector movably mounted to said sprinkler body;

a sealing assembly for sealing said outlet;

a thermally sensitive trigger assembly configured to releasably urge said sealing assembly into sealing engagement with said outlet;

a housing attached to said sprinkler body and having a flange extending beyond said outlet;

a cover plate removably mounted to said flange of said housing, said cover plate having a first planar portion and an outermost radial periphery, said first planar portion having an outer surface lying in a plane generally orthogonal to said central axis, said cover plate further including a plurality of arcuate portions extending from the outermost radial periphery of the cover plate and projecting outwardly from said plane away from said sprinkler body in a direction generally along said central axis and extending inwardly from said outermost radial periphery, said arcuate portions forming passageway sections each having a portion offset outwardly from said plane and in said direction and configured to enable air to travel between said outermost radial periphery and said flange of said housing and towards said thermally sensitive trigger assembly.

9. The concealed sprinkler head according to claim 8, wherein said cover plate includes a plurality of second planar portions in between said plurality of arcuate portions.

10. The concealed sprinkler head according to claim 8, wherein said arcuate portions are generally parallel to each other.

11. The concealed sprinkler head according to claim 8, wherein said arcuate portions are radially arranged around said cover plate wherein said passageway sections generally extend along radii extending outwardly from said central axis.

12. The concealed sprinkler head according to claim 11, wherein said cover plate includes a plurality of second planar portions, said plurality of second planar portions extending between said respective arcuate portions.

13. The concealed sprinkler head according to claim 11, wherein said passageway sections are tapered from said outermost radial periphery inwardly along said radii.

14. The concealed sprinkler head according to claim 13, wherein said first planar portion comprises a central planar portion having an outer diameter smaller than an opening of said housing at said flange of said housing.

15. The concealed sprinkler head according to claim 14, wherein said passageway sections terminate at or adjacent said central planar portion of said cover plate.

16. The concealed sprinkler head according to claim 8, further comprising a spring positioned between an inner surface of said cover plate and said flange of said housing to thrust said cover plate away from said housing.

17. The concealed sprinkler head according to claim 16, wherein said flange of said housing comprises an annular flange.

* * * * *